US006170966B1

(12) United States Patent
Schwarzmann

(10) Patent No.: US 6,170,966 B1
(45) Date of Patent: Jan. 9, 2001

(54) TROUBLE LIGHT

(76) Inventor: Frank Schwarzmann, 4151 Elmwood Rd., Colgate, WI (US) 53017

( * ) Notice: Under 35 U.S.C. 154(b), the term of this patent shall be extended for 0 days.

(21) Appl. No.: 09/209,382

(22) Filed: Dec. 10, 1998

Related U.S. Application Data

(63) Continuation-in-part of application No. 09/133,671, filed on Aug. 12, 1998.

(51) Int. Cl.[7] ..... F21V 21/00

(52) U.S. Cl. ..... 362/376; 362/449; 362/277; 362/319

(58) Field of Search ..... 362/399, 418, 362/449, 277, 282, 284, 319, 322, 376

(56) References Cited

U.S. PATENT DOCUMENTS

| | | | | |
|---|---|---|---|---|
| 811,810 | * | 2/1906 | Wood | 362/376 |
| 870,637 | * | 11/1907 | Moliter | 362/376 |
| 2,554,565 | * | 5/1951 | Fike | 362/284 |
| 2,602,880 | * | 7/1952 | Engelhardt et al. | 362/282 |
| 3,755,668 | * | 8/1973 | Moreschini | 362/282 |
| 4,086,482 | | 4/1978 | Torgerson | 362/376 |
| 4,236,195 | | 11/1980 | Kovacik | 362/376 |
| 4,298,922 | * | 11/1981 | Hardwick | 362/376 |
| 4,419,720 | * | 12/1983 | Kenney | 362/376 |
| 4,594,647 | * | 6/1986 | Dippert | 362/282 |
| 4,639,842 | | 1/1987 | Upchurch | 362/376 |
| 4,864,477 | * | 9/1989 | Upchurch | 362/376 |
| 5,072,352 | * | 12/1991 | Rosenschein | 362/282 |
| 5,154,511 | * | 10/1992 | Veneskey | 362/282 |
| 5,416,685 | * | 5/1995 | Myers | 362/399 |
| 5,568,968 | * | 10/1996 | Jaramillo | 362/376 |

* cited by examiner

*Primary Examiner*—Alan Cariaso
*Assistant Examiner*—Ronald E. Del Gizzi
(74) *Attorney, Agent, or Firm*—Michael Best & Freidrich LLP

(57) ABSTRACT

Disclosed herein is a trouble light comprising a handle including a light bulb socket adapted to receive an electric light bulb, a cage mounted on the handle and adapted to enclose the light bulb, and a reflector located within the cage. The reflector is mounted on the handle so as to allow for the rotary movement of the reflector relative to the handle.

14 Claims, 4 Drawing Sheets

TROUBLE LIGHT

RELATED APPLICATION

This application is a continuation-in-part application based on U.S. Ser. No. 09/133,671, filed Aug. 12, 1998.

BACKGROUND OF THE INVENTION

The invention relates generally to trouble lights and, more particularly, to trouble lights including reflectors. In the past, such reflectors were commonly fixed relative to the handle and, as a consequence, the direction of reflection was often determined by the manner in which the trouble light hook engaged the supporting member. Such direction of reflection was, accordingly, often in a direction which did not maximize the light available to the user at the spot where the user was working.

Attention is directed to the following U.S. Patents:

U.S. Pat. No. 4,086,482, Torgerson, issued Apr. 24, 1978

U.S. Pat. No. 4,236,195, Kovacik, issued Nov. 25, 1980

U.S. Pat. No. 4,639,842, Upchurch, issued Jan. 27, 1987

U.S. Pat. No. 4,864,477, Engelman, issued Sep. 5, 1989

SUMMARY OF THE INVENTION

The invention provides a trouble light comprising a handle including a light bulb socket fixed in the handle and adapted to receive an electric light bulb, a cage mounted on the handle and adapted to enclose the light bulb, a reflector located within the cage, and means on the reflector and on one of the handle and the socket for mounting the reflector on the one of the handle and the socket for rotary movement relative to the handle.

The invention also provides a trouble light comprising a handle including an end portion, a light bulb socket located adjacent said end portion and adapted to receive an electric light bulb, and an electric switch operable to control energizing of said light bulb socket, a protective cage mounted on said end portion of said handle, adapted to enclose and protect the light bulb, and including openable structure for passing an electric bulb into said protective cage for threaded insertion into said light bulb socket, and a hook for suspending said trouble light from a support, a reflector located within said cage, and means on said reflector and on said end portion of said handle for mounting said reflector on said handle for rotary movement relative to said handle. The invention also provides a trouble light comprising a handle including an end portion, a light bulb socket located adjacent the end portion and adapted to receive an electric light bulb, and an electric switch operable to control energizing of the light bulb socket, a cage mounted on the end portion of the handle, adapted to enclose and protect the light bulb, and including an openable structure for passing an electric light bulb into the cage for threaded insertion into the light bulb socket, and a hook for suspending the trouble light from a support, an annular collar fixedly mounted on the cylindrical portion of the end portion of the handle and including two half-sections each including a partially cylindrical inner surface portion frictionally engaging the cylindrical portion of the end portion of the handle, an arcuate groove extending radially outwardly from the partially cylindrical inner surface portion, and a partially cylindrical outer surface portion spaced radially outwardly from the partially cylindrical inner surface portion and from the cylindrical portion of the handle to form an annular space between the handle and the partially cylindrical outer surface portions, and a reflector located within the cage and including an end portion comprising a cylindrical portion located in the annular space between the cylindrical portion of the handle and the partially cylindrical outer portions of the collar, and a flange extending radially outwardly from the cylindrical portion of the end portion of the reflector and located in the grooves of the half sections of the collar, and fasteners connecting together the half-sections and frictionally engaging the cylindrical inner surface portions of the half-sections of the collar against the cylindrical portion of the handle.

The invention also provides a trouble light comprising a handle including a pair of partial-sections, one of said partial-sections integrally including a first collar segment, and a second collar segment assembled to the one partial-section, a light bulb socket fixed in the handle and adapted to receive an electric light bulb, a cage mounted on the handle and adapted to enclose the light bulb, a reflector located within the cage, and means on the reflector and on the first and second collar segments for mounting the reflector on the handle for rotary movement relative to the handle.

The invention also provides a trouble light comprising a handle including a first half-section, a second half-section including a first collar segment, a second collar segment assembled to the first collar segment to form a collar, a light bulb socket located adjacent the collar and adapted to receive an electric light bulb, and an electric switch operable to control energizing of the light bulb socket, a protective cage mounted on the handle, adapted to enclose and protect the light bulb, and including openable structure for passing an electric bulb into the protective cage for threaded insertion into the light bulb socket, and a hook for suspending the trouble light from a support, a reflector located within the cage, and means on the reflector and on the collar for mounting the reflector on the handle for rotary movement relative to the handle.

Other features and advantages of the invention will become apparent to those skilled in the art upon review of the following detailed description, claims and drawings.

Figure 1:
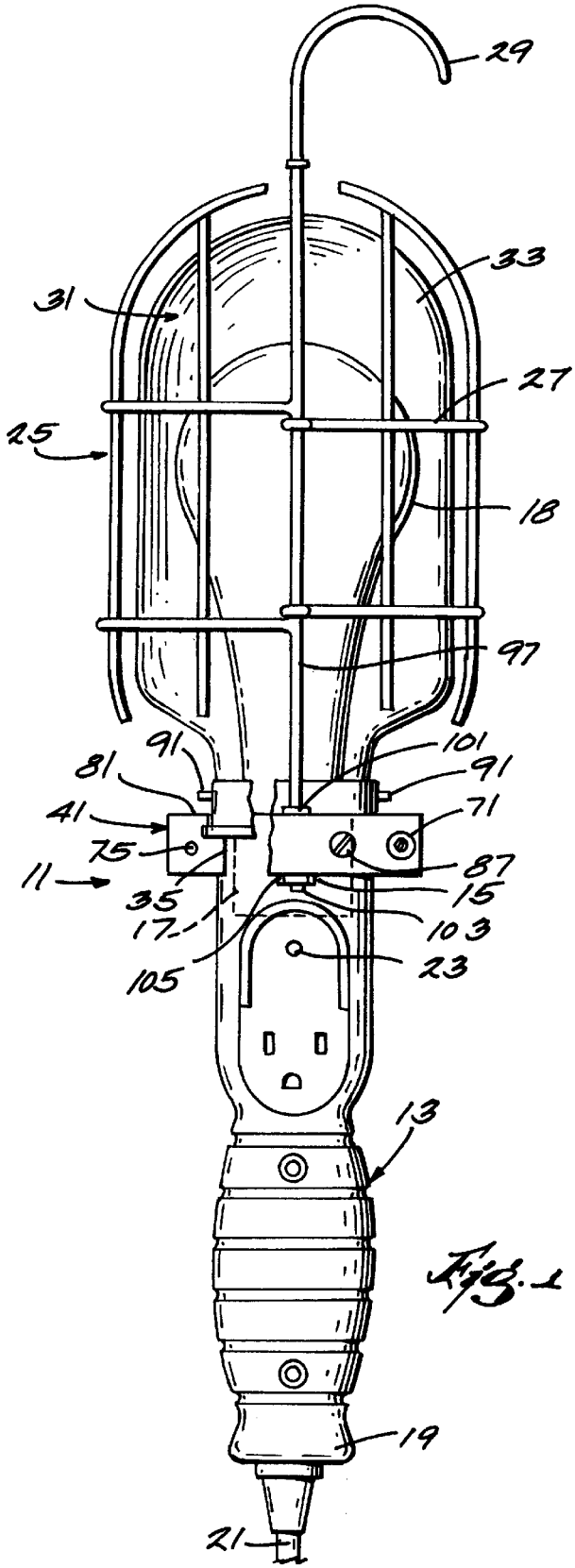
FIG. 1 is a side elevational view of a trouble light incorporating various of the features of the invention.
Figure 4:
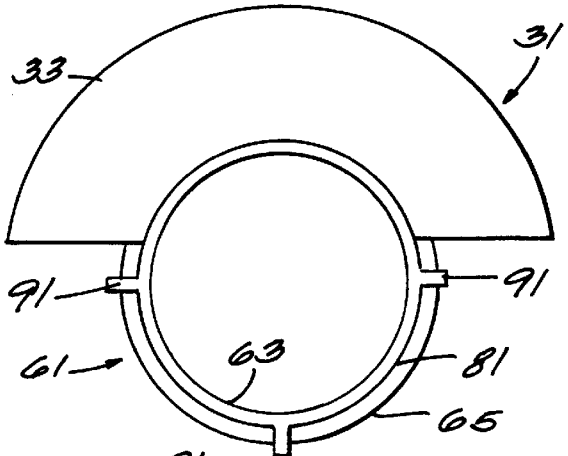
FIG. 4 is an enlarged plan view of the reflector incorporated in the trouble light shown in FIG. 1.
Figure 5:
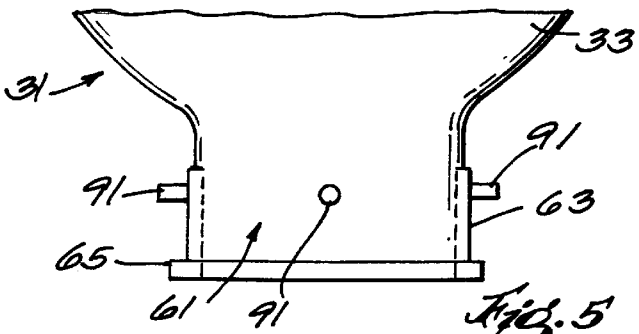
FIG. 5 is a fragmentary, side elevational view of the reflector shown in FIG. 4.
Figure 2:
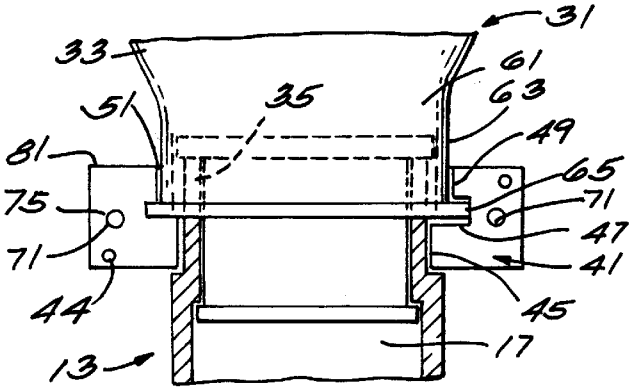
FIG. 2 is a fragmentary view, partially in section, of a portion of the trouble light shown in FIG. 1.
Figure 3:
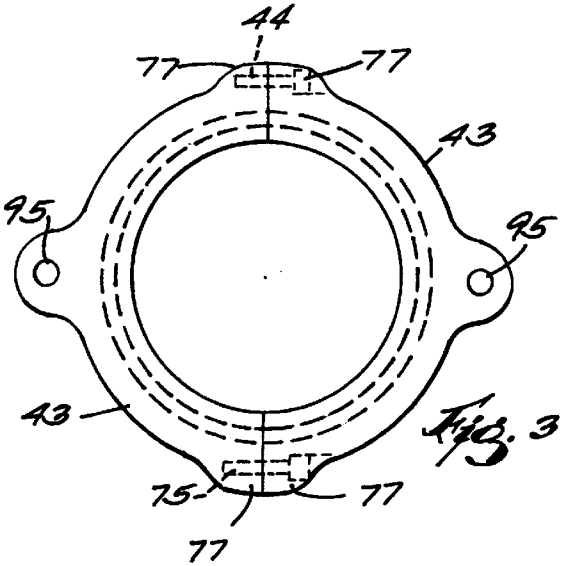
FIG. 3 is a slightly enlarged plan view, partially in section, of the collar incorporated in the trouble light shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in the drawings is a trouble light 11 which embodies various of the features of the invention and which comprises an elongated handle 13 which can be fabricated of any suitable material and which can be of any suitable configuration except as indicated hereinafter. As is conventional, the handle 13 includes a socket end 15 including a socket 17 adapted to receive an electric light bulb 18, and a remote end 19 from which an electrical cord 21 extends. Intermediate the ends 15 and 19, or adjacent the socket 17, the handle 13 also conventionally includes a suitable electric switch 23 which is connected between the socket 17 and the cord 21 and which is operative to control the flow of electric current to the socket 17.

The trouble light 11 also includes a protective cage 25 which is suitably mounted on said socket end 15 of said handle 13, which is adapted to enclose and protect the light bulb, which can be fabricated of any suitable material, and which can be of any suitable configuration. As is conventional, the protective cage 25 includes openable structure or portion 27 for passing an electric bulb into said protective cage 25 for threaded insertion into said light bulb socket 17, and a suitably formed hook 29 for suspending said trouble light 11 from a suitable support (not shown).

The trouble light 11 also conventionally includes a reflector 31 which can be fabricated of any suitable material and which can be of any suitable configuration, except as indicated hereinafter. As compared to prior constructions wherein the reflector was commonly a part of the protective cage, in the disclosed construction, the reflector 31 is separate from the protective cage 25, is located within the protective cage 25, and is mounted on the handle 13 for rotation relative to the handle 13. In general, the reflector conventionally includes a main portion 33 which is generally oval and dished or concave in shape, having a major dimension in the direction of elongation of the handle 13 and a minor dimension in the direction transverse to the major dimension.

While other constructions can be employed, in the disclosed construction, the reflector 31 is rotatably mounted on the handle 13 by means including formation of the socket end 15 of the handle 13 with an end or mounting portion 35 having an outer surface of cylindrical configuration.

In addition, the arrangement for mounting the reflector 31 on the handle 13 includes an annular collar 41 which can be fabricated of any suitable material which is, preferably, electrically insulating. The annular collar 41 is fixedly mounted on said cylindrical end portion 35 of said socket end 15 of said handle 13 and, preferably, is formed to include two, generally identical, generally semi-cylindrical half-sections 43 each including a first or inner partially cylindrical surface portion 45 frictionally engaging said outer surface of the cylindrical end portion 35 of said socket end 15 of said handle 13. The two half-sections 43 also each include an arcuate groove 47 extending radially outwardly from said first partially cylindrical inner surface portion 45, and a second or outer partially cylindrical surface portion 49 spaced radially outwardly from said first or inner partially cylindrical surface portion 45 and from the cylindrical end portion 35 of said handle 13 to form an annular space 51 between said handle 13 and said second or outer partially cylindrical surface portions 49. The half sections 43 can be provided with one or more pilot pins and associated apertures 44 to assist in properly aligning the half-sections 43 relative to each other.

In addition, the arrangement for mounting the reflector 31 on the handle 13 includes formation of the reflector 31 to include an end or base portion 61 extending from the main portion 33, located adjacent the handle 13, and comprising a cylindrical portion 63 located, at least in part, in said annular space 51 between said cylindrical end portion 35 of said handle 13 and said second or outer cylindrical portions 49 of said collar 41. The base portion 61 of the reflector 31 also includes a flange 65 extending radially outwardly from said cylindrical portion 63 of said base or end portion 61 of said reflector 31 and located in said grooves 47 of said half-sections 43 of said collar 41.

Still further in addition, the arrangement for mounting the reflector 31 on the handle 13 includes fasteners 71 connecting together said half-sections 43 so as to form the annular collar 41 and so as to frictionally engage said first or inner partially cylindrical surface portions 45 of said half-sections 43 of said collar 41 against said cylindrical end portion 35 of said handle 13. While other fasteners can be employed, in the disclosed construction, the fasteners 71 comprise threaded screws which pass through apertures 75 in enlarged portions 77 of one of the half-sections 43 and are threaded into enlarged portions 77 in the other of the half-sections 43. The enlarged portions 77 and 79 can be of any suitable configuration.

Preferably, the trouble light also includes an arrangement for preventing unwanted rotary movement of the reflector 31 relative to the handle 13 while, at the same time, facilitating user adjustment of the angular or rotary location of the reflector 31 relative to the handle 13. In this regard, one of the collar segments includes a threaded aperture which receives a threaded screw 87 which is frictionally engaged against the outer surface of the cylindrical portion 63 of the reflector base or end portion 61 so as to establish sufficient friction between the cylindrical portion 63 of the reflector base or end portion 61 and the collar to permit rotary movement therebetween in response to action of the user while, at the same time, preventing undesired relative rotary movement therebetween.

Also in this regard, the cylindrical portion 63 of the base or end portion 61 of the reflector 31 includes one or more outwardly extending tabs or points 91 for engagement by the user's hand to facilitate rotation of the reflector 31 by the user to the desired angular position of the reflector 31 relative to the handle 13. While other constructions can be employed, in the disclosed construction, four such tabs 91 extend in equi-angular spacing from the cylindrical portion 63 of the reflector 31.

While the above description has indicated that the protective cage 25 is mounted on the handle 13, in the particularly disclosed construction, it is preferred to mount the protective cage 25 to the collar 41 which, as already indicated, is fixedly mounted on the handle 13. In this regard, each of the half-sections 43 of the collar 41 includes an aperture 95 extending in the direction of elongation of the handle 13, and the protective cage 25 includes a pair of extending legs 97 which extend toward the handle, which respectively include an enlarged annular rib or boss 101 and a threaded portion 103 which extends from the annular rib or boss 101 toward the handle 13. The threaded portions 103 pass through the apertures 95 in the half-sections 43 until the annular ribs 101 engage with the adjacent or outer surface of the collar 41. Nuts 105 are applied to the threaded portions 103 to engage the nuts 105 against the adjacent or lower surface of the collar 41 to tightly assembly the protective cage 25 to the collar 41 and thus to the handle 13.

In an alternative construction not specifically shown in the drawings, the socket 17 can be suitably fixed against rotation relative to the handle 13 and provided, near the outer end thereof, with a cylindrical outer surface portion (not shown) on which the collar 41 can be mounted. Thus, the reflector 31 and the protective cage 25 can be mounted through the collar 41 from the socket 17, as well as from the socket end 15 of the handle 13 as shown in the drawings.

In use, the trouble light 11 can be supported by engaging the hook 29 of the protective cage 25 with a supporting member and, after the trouble light 11 stabilizes, the reflector 31 can be manually rotated by the user relative to the handle 13 to the desired angular position to maximize light in the desired area, without disturbing the hanging support of the trouble light 11.

Figure 6:
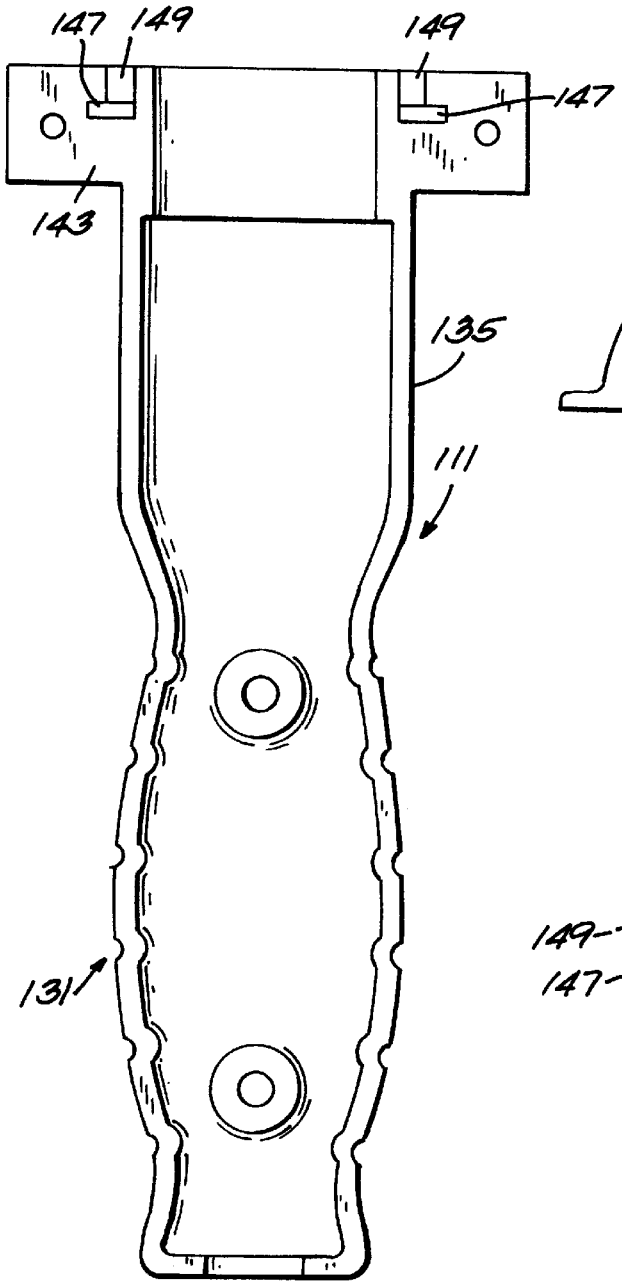
FIG. 6 is elevational view of one of the half-sections of a modified embodiment of a trouble light embodying various of the features of the invention.
Figure 7:
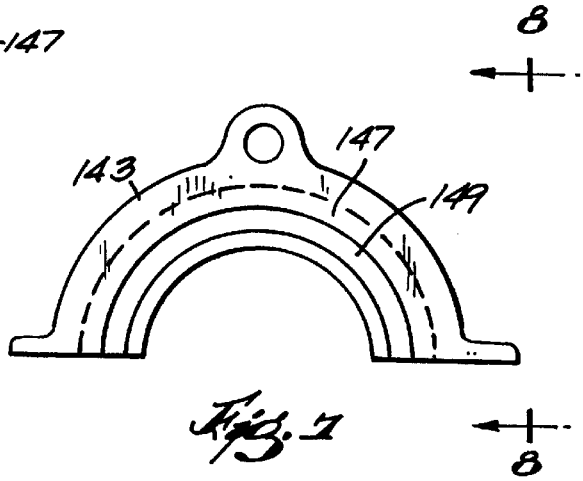
FIG. 7 is an end view of the half-section shown in FIG. 6.
Figure 8:
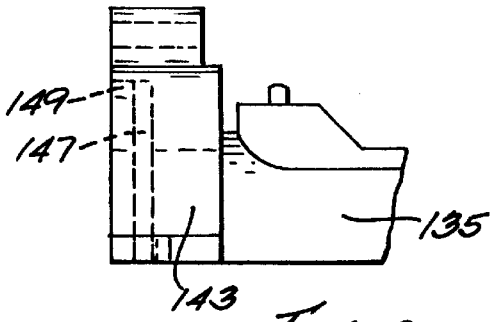
FIG. 8 is a view taken along line 8—8 of FIG. 7.

Shown in FIGS. 6 through 8 is a second and preferred embodiment of a trouble light 111 which, except as described hereinafter, is of the same construction as the trouble light 11 shown in FIGS. 1 through 5. The trouble light 111 includes a modified handle 131 which is otherwise generally identical to the handle 13, and in this regard, is formed of two half-sections 135 (only one of which is shown) which are generally identical, except as hereinafter described, and which are fabricated of electrically insulating plastic. As compared to the previously described handle 13, the illustrated handle half-section 135 has been modified to include, as an integral part thereof, a part or segment 143 of the before-mentioned collar 41.

Thus, the handle 131 includes the half-section 135 including the collar part or segment 143, a half section (not shown) that is generally identical to the handle half-section 135 except for omission of the collar segment or part 143, and a separate or independent collar segment or part (not specifically shown) which is generally of the same construction as the previously-described collar segment 43 and which is suitably assembled to the handle half-section 135 including the collar part or segment 143.

The collar part or segment 143 formed as part of the handle half-section 135 includes a radially extending annular recess or groove 147 adapted to receive the flange 65 of the reflector 31 and an axially extending, annular slot 149 which is radially outwardly spaced from the part of the socket 17 formed in the handle half-section 135. The axially extending slot communicates with the recess or groove 147 and is adapted to receive the cylindrical portion 63 of the base or end portion 61 of the reflector 31.

In assembly, the cylindrical portion 63 and the flange 65 of the base or end portion 61 of the reflector 31 are engaged in the groove or slot 147 of the collar segment 143 and the other segment of the collar 41 is assembled to the handle half-section 135 by screws (not shown) or other suitable fasteners in the same general manner as the assembly of the collar 41 of the embodiment shown in FIGS. 1 through 5. As a consequence of such assembly, the reflector 31 can be rotated to any desired position relative to the handle 131.

Figure 9:
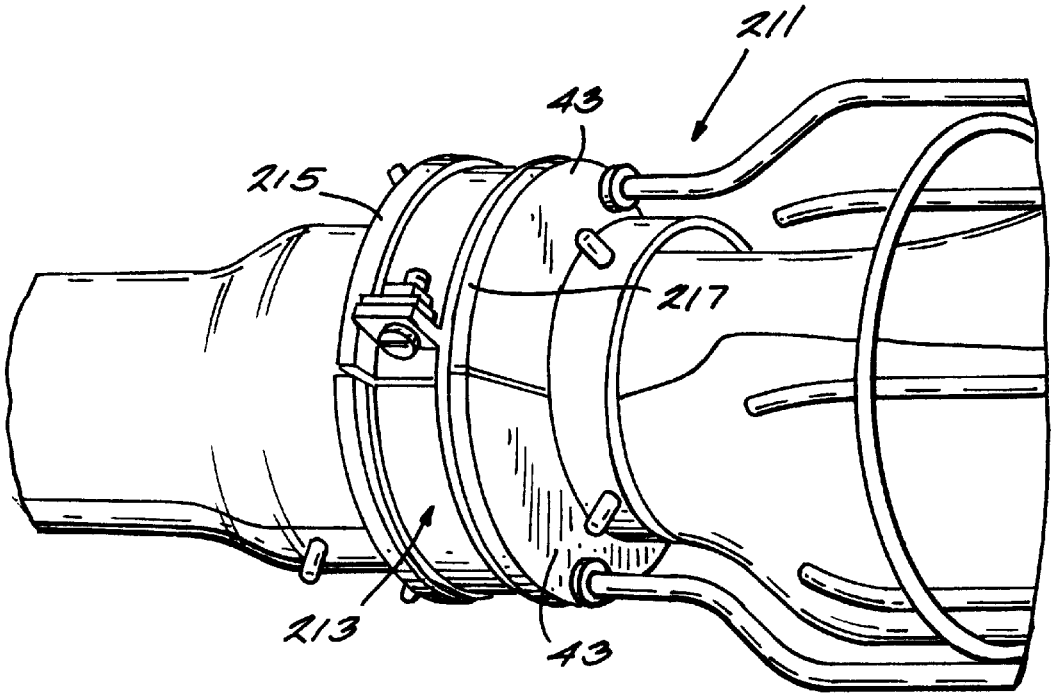
FIG. 9 is a fragementary perspective view of a further modified embodiment of a trouble light embodying various of the features of the invention.

Fragmentarily shown in FIG. 9 is another embodiment of a trouble light 211 which can be constructed, except as noted hereinafter, the same as shown in FIGS. 1 through 5 or as shown in FIGS. 6 through 8. In the trouble light 211 shown in FIG. 9, the collar segments 43 are retained in assembled relation by use of an adjustable flexible band 213 which encircles the collar segments 43 and is retained in proper position by axially spaced and radially outwardly projecting flanges 215 and 217 extending from the collar segments 43.

Various of the features are set forth in the following claims.

What is claimed is:

1. A trouble light comprising a handle including an end portion, a light bulb socket located adjacent said end portion and adapted to receive an electric light bulb, and an electric switch operable to control energizing of said light bulb socket, a protective cage mounted on said end portion of said handle, adapted to enclose and protect the light bulb, and including openable structure for passing an electric bulb into said protective cage for threaded insertion into said light bulb socket, and a hook for suspending said trouble light from a support, a reflector located within said cage, and means on said reflector and on said end portion of said handle for mounting said reflector on said handle for rotary movement relative to said handle, wherein said means for mounting said reflector on said handle comprises a cylindrical portion on said end of said handle, a collar fixedly mounted on said cylindrical portion of said end of said handle and including a first cylindrical inner surface portion frictional engaging said cylindrical portion of said end of said handle, an annular groove extending radially outwardly from said first cylindrical inner surface portion, and a second cylindrical inner surface portion spaced radially outwardly from said first cylindrical inner surface portion, and an end portion on said reflector and including a cylindrical portion located between said cylindrical portion of said handle and said second cylindrical portion of said collar, and a flange located in said groove of said collar and extending radially outwardly from said cylindrical portion of said end portion of said reflector.

2. A trouble light in accordance with claim 1 wherein said collar is annular and includes two half-sections, and wherein said means for mounting said reflector on said handle also includes fasteners connecting together said half-sections so as to frictionally engage said cylindrical inner surface portions of said collar against said cylindrical portion of said handle.

3. A trouble light comprising a handle including an end portion having a cylindrical portion, a light bulb socket located adjacent said end portion and adapted to receive an electric light bulb, and an electric switch operable to control energizing of said light bulb socket, a cage mounted on said end portion of said handle, adapted to enclose and protect said light bulb, and including openable structure for passing an electric light bulb into said cage for threaded insertion into said light bulb socket, and a hook for suspending said trouble light from a support, an annular collar fixedly mounted on said cylindrical portion of said end portion of said handle and including two half-sections each including a partially cylindrical inner surface portion frictionally engaging said cylindrical portion of said end portion of said handle, an arcuate groove extending radially outwardly from said partially cylindrical inner surface portion, and a partially cylindrical outer surface portion spaced radially outwardly from said partially cylindrical inner surface portion and from said cylindrical portion of said handle to form an annular space between said handle and said partially cylindrical outer surface portion, and a reflector located within said cage and including an end portion comprising a cylindrical portion located in said annular space between said cylindrical portion of said handle and said partially cylindrical outer portions of said collar, and a flange extending radially outwardly from said cylindrical portion of said end portion of said reflector and located in said grooves of said half-sections of said collar, and fasteners connecting together said half-sections and frictionally engaging said cylindrical inner surface portions of said half-sections of said collar against said cylindrical portion of said handle.

4. A trouble light in accordance with claim 3 wherein said cylindrical portion of said end portion of said reflector extends outwardly from said collar and includes an outwardly extending tab adapted to be manipulated by a user to rotate said reflector.

5. A trouble light in accordance with claim 3 wherein said annular collar includes therein an aperture, and further including a screw extending through said aperture and frictionally engaging said cylindrical portion of said reflector to prevent unwanted rotation of said reflector relative to said handle.

6. A trouble light in accordance with claim 3 wherein said handle extends in elongated relation from said end portion of said handle, wherein said collar includes an outer surface extending transversely to the direction of elongation of said handle, a lower surface spaced from said outer surface in the direction of elongation of said handle, and a pair of apertures extending between said outer and lower surfaces and in the direction of elongation of said handle, and wherein said protective cage includes two legs extending through said apertures toward said handle and each including an annular rib engaging said outer surface of said collar, and a portion which extends from said annular rib and which is threaded, and further including nuts respectively threaded on said threaded portions of said legs of said protective cage and engaging said lower surface of said collar to fixedly assembly said protective cage to said collar, and hence to said handle.

7. A trouble light comprising a handle including a first half-section, a second half-section including a first collar segment, a second collar segment assembled to said first collar segment to form a collar, a light bulb socket located adjacent said collar and adapted to receive an electric light bulb, and an electric switch operable to control energizing of the light bulb socket, a protective cage mounted on said handle, adapted to enclose and protect the light bulb, and including openable structure for passing an electric bulb into the protective cage for threaded insertion into the light bulb socket, and a hook for suspending the trouble light from a support, a reflector located within said cage, and means on said reflector and on said collar for mounting said reflector on said handle for rotary movement relative to said handle, wherein said means for mounting said reflector on said handle comprises a radially outwardly extending groove located in said handle, an axially extending slot located in said handle and communicating with said groove, and an end portion of the reflector having a cylindrical portion adapted to be received in said groove and said slot.

8. A trouble light in accordance with claim 7 and further including means for retaining said first and second collar segments in assembled relation.

9. A trouble light in accordance with claim 7 wherein said means for retaining said first and second collar segments in assembled relation comprises fasteners extending between said first and second collar segments.

10. A trouble light in accordance with claim 7 wherein said means for retaining said first and second collar segments in assembled relation comprises a band encircling said first and second collar segments.

11. A trouble light comprising a handle including a first half-section, a second half-section including a first collar segment, a second collar segment assembled to said first collar segment to form a collar, a light bulb socket located adjacent said collar and adapted to receive an electric light bulb, and an electric switch operable to control energizing of the light bulb socket, a protective cage mounted on said handle, adapted to enclose and protect the light bulb, and including openable structure for passing an electric bulb into the protective cage for threaded insertion into the light bulb socket, and a hook for suspending the trouble light from a support, a reflector located within said cage, and means on said reflector and on said collar for mounting said reflector on said handle for rotary movement relative to said handle, wherein said means for mounting said reflector on said handle comprises a radially outwardly extending groove located in said handle, and an axially extending slot located in said handle and communicating with said groove, and an end portion on said reflector and including a flange extending radially outwardly and located in said groove of said handle, and a cylindrical portion extending from said flange and located in said axially extending slot, whereby to rotatably support said reflector from said handle and to afford rotary movement of said reflector relative to said handle.

12. A trouble light in accordance with claim 11 and further including means for retaining said first and second collar segments in assembled relation.

13. A trouble light in accordance with claim 12 wherein said means for retaining said first and second collar segments in assembled relation comprises fasteners extending between said first and second collar segments.

14. A trouble light in accordance with claim 12 wherein said means for retaining said first and second collar segments in assembled relation comprises a band encircling said first and second collar segments.

* * * * *